United States Patent [19]

Blasiole

[11] 4,455,154

[45] Jun. 19, 1984

[54] HEAT EXCHANGER FOR COAL GASIFICATION PROCESS

[75] Inventor: George A. Blasiole, Greensburg, Pa.

[73] Assignee: The United States of America as represented by the United States Department of Energy, Washington, D.C.

[21] Appl. No.: 369,720

[22] Filed: Apr. 16, 1982

[51] Int. Cl.[3] ..... C01J 3/68

[52] U.S. Cl. ..... 48/77; 48/197 R; 48/210; 55/269; 55/432; 55/459 R; 165/119; 165/156

[58] Field of Search ..... 55/267–269, 55/1, 80, 459 R, 428–432, 466; 165/156, 155, 119, 109, 95, 158, 154, DIG. 27, 174; 48/197 R, 210, 62 R, 77

[56] References Cited

U.S. PATENT DOCUMENTS

| | | | |
|---|---|---|---|
| 1,603,020 | 10/1926 | Boldt | 55/459 R |
| 1,770,208 | 7/1930 | Kemnal | 165/174 |
| 1,773,954 | 8/1930 | Coutant | 55/432 |
| 1,818,343 | 8/1931 | Monroe | 165/156 |
| 2,070,427 | 2/1937 | Faunce | 165/95 |
| 2,236,358 | 3/1941 | Allardice | 55/269 |
| 2,437,294 | 3/1948 | Dalin | 55/269 |
| 2,700,599 | 1/1955 | Kalbach | 48/62 R |
| 2,703,225 | 3/1955 | Cooper | 165/155 |
| 3,800,985 | 4/1974 | Grout et al. | 138/38 |
| 3,897,739 | 8/1975 | Goldbach | 110/216 |
| 4,009,751 | 3/1977 | Zelnik | 165/156 |

*Primary Examiner*—Bernard Nozick
*Attorney, Agent, or Firm*—W. E. Otto

[57] ABSTRACT

This invention provides a heat exchanger, particularly useful for systems requiring cooling of hot particulate solids, such as the separated fines from the product gas of a carbonaceous material gasification system. The invention allows effective cooling of a hot particulate in a particle stream (made up of hot particulate and a gas), using gravity as the motive source of the hot particulate.

In a preferred form, the invention substitutes a tube structure for the single wall tube of a heat exchanger. The tube structure comprises a tube with a core disposed within, forming a cavity between the tube and the core, and vanes in the cavity which form a flow path through which the hot particulate falls. The outside of the tube is in contact with the cooling fluid of the heat exchanger.

2 Claims, 4 Drawing Figures

HEAT EXCHANGER FOR COAL GASIFICATION PROCESS

GOVERNMENT CONTRACT CLAUSE

The invention disclosed herein was made or conceived in the course of or under, a contract with the United States Government identified as No. DE-AC01-80-ET-14752.

BACKGROUND OF THE INVENTION

1. Field of the Invention

This invention relates to gasification of carbonaceous materials, and more particularly to apparatus for cooling the particles separated from product gas of fluidized bed gasification reactors.

2. Description of the Prior Art:

In reactors for the gasification of carbonaceous materials, such as coal, a combustible product gas is produced, as well as solid waste products such as agglomerated ash. In the Process Development Unit (PDU) fluidized bed gasification reactor being operated for the United States Government, particulate coal is injected through one of a number of concentric tubes extending upwardly into the center of a vertical bed-containing pressure vessel. Fluidization occurs in the upper sections.

In the PDU fluidized bed gasification reactor, the product gas from gasified coal contains a significant amount of particles whose temperature is near the gasifier exit temperature of approximately 1800° F. These particles must be removed from the product gas and disposed of to prevent disruption of downstream processing of the product gas. During separation by, for example, a cyclone separator, the particles fall by gravity to the bottom of the separator, then through piping to a particulate discharge system. This discharge system has as its purpose the retention of product gas during the discharge of particulate from the gasification system. As a result, numerous parts of the discharge system are made of rubber, plastic or other compositions which will not stand up to prolonged periods of high temperature. It is therefore necessary to cool the hot particulate prior to its entry into the discharge system.

At the same time, the characteristics of the hot particulate require an improved heat exchanger. Since the particle/wall contact in a straight tube heat exchanger is intermittent and of short duration, what is needed is a heat exchanger which will improve the heat exchange rate. In addition, since a particle stream is involved, an efficient means is needed for moving the particles through the heat exchanger which will not be adversely effected by the heat of the particles.

SUMMARY OF THE INVENTION

This invention provides a heat exchanger, particularly useful for systems requiring cooling of hot particulate solids, such as the separated fines from the product gas of a carbonaceous material gasification system. The invention allows effective cooling of a hot particulate in a particle stream (made up of hot particulate and a gas), using gravity as the motive source of the hot particulate.

In a preferred form, the invention substitutes a tube structure for the single wall tube of a heat exchanger. The tube structure comprises a tube with a core disposed within, forming a cavity between the tube and the core, and vanes in the cavity which form a flow path through which the hot particulate falls. The outside of the tube is in contact with the cooling fluid of the heat exchanger.

BRIEF DESCRIPTION OF THE DRAWINGS

The advantages, nature and additional features of the invention will become more apparent from the following description taken in connection with the accompanying drawings, in which.

DESCRIPTION OF THE PREFERRED EMBODIMENT

Figure 1:
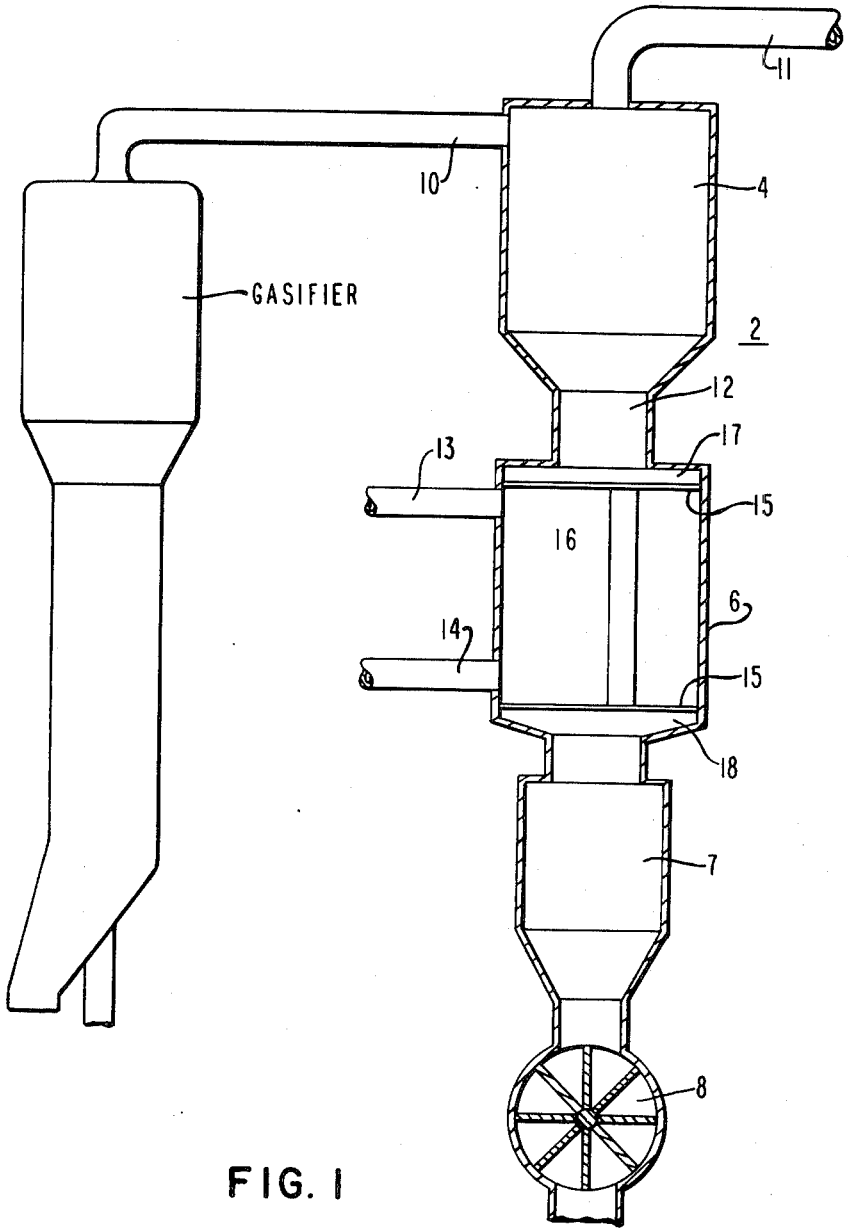
FIG. 1 is a partial sectional elevational view of a tube structure in accordance with the invention.

Referring now to FIG. 1, there is shown a typical particulate removal and cooling system 2, comprising a cyclone separator 4 as is well known in the art, and disposed below is a particulate heat exchanger 6 in accordance with the invention, and disposed below the heat exchanger 6 is a hopper 7 and a starwheel feeder 8, as are well known in the art. The cyclone separator 4 further comprises a product gas inlet 10, a clean gas outlet 11 and a particulate outlet 12. The particulate heat exchanger 6 further comprises a cooling fluid inlet 13 and a cooling fluid outlet 14, tube sheets 15, tube structure 16, a heat exchanger particulate inlet 17 and a heat exchanger particulate outlet 18.

Figure 2:
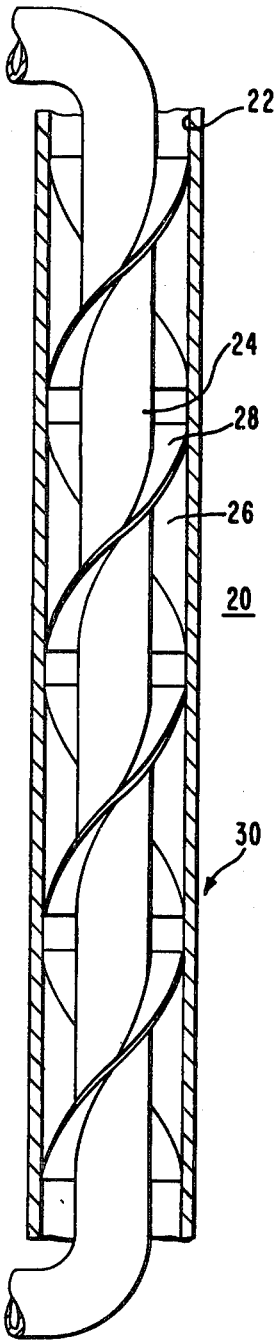
FIG. 2 is an elevational view of a tube structure in accordance with the invention.
Figure 3:
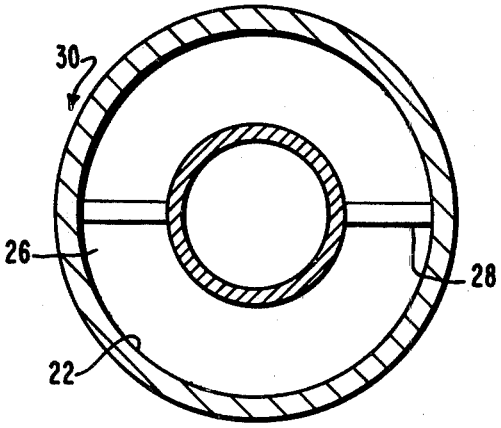
FIG. 3 is a partial sectional plan view of a tube structure showing an alternative vane design in accordance with the invention.
Figure 4:
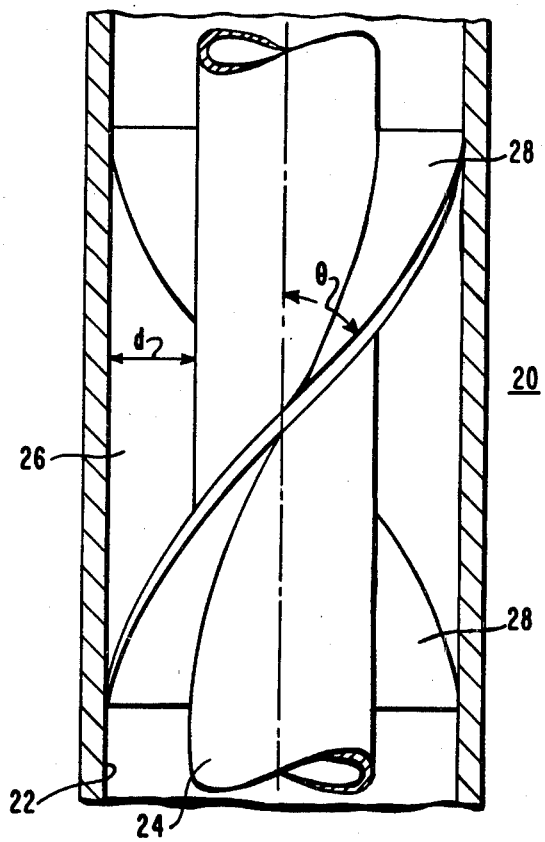
FIG. 4 is an elevational view of a tube structure in accordance with the invention.

Referring now to FIGS. 2, 3 and 4, there is shown a heat exchanger tube structure 20 in accordance with the invention. The tube structure 20 comprises a first tube 22, a core member 24 disposed within and extending axially through the first tube 22, thereby forming an annular cavity 26 between the core member 24 and the first tube 22 and at least one directing means, such as a vane 28 disposed within and extending the length of the cavity 26. The outside of the first tube 22 is cooled by a cooling fluid 30 such as water, and the ends of the tube structure 20 are restrained and attached to a tube sheet as is well known in the art of heat exchangers. In a preferred form, the inside of the core member 24 is cooled by the cooling fluid 30.

Looking more closely at FIG. 4, the vane 28 will be offset from the longitudinal axis A by an angle $\theta$, typically between 15° and 30°. The cavity 26 between the first tube 22 and the core member 24 is a distance d, typically of one-half to 1 inch, and the vanes would extend substantially across the cavity 26. In a preferred form, a plurality of vanes 28 are used which are discontinuous over the length of the tube structure 20.

With respect to material composition, any components of the tube structure 20 which are directly cooled by the cooling fluid 30 could be made of a material without exceptional corrosion resistance properties, such as carbon steel. An example of such components is the first tube 22.

Any component not directly cooled by the cooling fluid 30, such as the vanes 28, could be made of a corrosion resistant material such as stainless steel.

Referring again to FIG. 1, the operation of the particulate removal and cooling system is as follows. Product gas from a carbonaceous material gasifier, such gas containing a particulate matter, enters the cyclone separator 4 through the product gas inlet 10. The cyclone separator 4 separates particulate from the product gas as is well known in the art, and product gas leaves the cyclone separator 4 through the clean gas outlet 11 while particulate falls by force of gravity out of the cyclone separator 4 through the particulate outlet 12. The particulate then falls as follows serially, into the particulate heat exchanger 6 through the heat exchanger particulate inlet 17, through the tube structure 16 then out through the heat exchanger particulate outlet 18 to the hopper 7 and starwheel feeder 8. A cooling fluid circulates through the particulate heat exchanger 6 by way of cooling fluid inlet 13 and outlet 14, cooling the tube structure 16. The cooling fluid will typically be water and the temperature will typically be between 40° F. and 150° F.

The starwheel feeder 8, as is well known in the art, has the primary purpose of preventing escape of product gas during release of particulate. As a result, the mass flow rate of product gas through the heat exchanger 6 is very low, and in an ideal theoretical design, the mass flow rate of the product gas through the particulate heat exchanger 6 would be zero.

Looking now at FIGS. 3 and 4, particulate falls through the cavity 26. The vanes 28 cause substantial turbulence and mixing and impingement by the hot particulate on the first tube 22 and the core member 24. This results in substantial cooling of the solid particulate over the length of the tube structure 10.

The invention uses vanes 28 in the flow path of the particulates to spiral the flow in the cavity 26 through the first tube 22 and around the core member 24 which results in a longer flow path for the particulate through the first tube 22.

The swirling flow imparts a radial force on the particulate which is thrown out to the cooling surface of the first tube 22 and provides direct contact with the heat transfer surface. The turbulence provided by the vane 28 promotes mixing in the particulate stream. The direct contact and mixing of the particulate permits direct conduction heat transfer between the first tube and the particulate with less dependence on conductive heat transfer through the gas which will typically have very poor conductivity.

I claim:

1. A carbonaceous material gasification system comprising:

a carbonaceous material gasifier which produces a fluid mixture comprising a combustible gas and particulate material;

a particulate separator;

conveying means for conveying said mixture to said separator;

a particulate cooler disposed below said separator and connected thereto, said cooler comprising a gravity flow pathway for said particulate material;

a first tube, disposed within said cooler, and preventing contact between said particulate material and a cooling fluid;

an axially extending core member disposed within said first tube forming a cavity between said first tube and said core member and through which cavity said particulate material descends;

means for passing said cooling fluid in direct heat exchange with said first tube and indirect heat exchange with said particulate material;

directing means disposed around said core member for directing said particulate material through said cavity in a tortuous path; and valve means for passing particulate from said cooler and for preventing flow of said gas through said cooler.

2. A process of gasifying and treating carbonaceous material, comprising the steps of:

(1) gasifying said carbonaceous material to form a solid waste and a product gas mixture comprising a combustible gas and particulate matter;

(2) separating said combustible gas and said particulate matter in a particle separator;

(3) conveying said particulate matter into an inlet in a heat exchanger;

(4) flowing said particulate matter downwardy by gravity through said heat exchanger through a cavity formed between a first tube and an axially extending core member disposed within said first tube;

(5) flowing a cooling fluid through said heat exchanger, said cooling fluid being in indirect heat exchange relationship and separated from said particulate matter but in direct heat exchange relationship with said first tube; and (6) flowing said particulate matter through valve means, said valve means inhibiting flow of said combustible gas through said heat exchanger.

* * * * *